US005467870A

United States Patent [19]

Broskow et al.

[11] Patent Number: 5,467,870

[45] Date of Patent: Nov. 21, 1995

[54] WRAPPER, CARRIER, AND HANDLE ASSEMBLY AND PACKAGE COMPRISING SAME AND CONTAINERS

[75] Inventors: James A. Broskow, Buffalo Grove; Leslie S. Marco, Bloomingdale, both of Ill.

[73] Assignee: Illinois Tool Works Inc., Glenview, Ill.

[21] Appl. No.: 317,312

[22] Filed: Oct. 3, 1994

[51] Int. Cl.[6] ..... B65D 75/00

[52] U.S. Cl. ..... 206/162; 206/150; 206/427

[58] Field of Search ..... 206/141, 143, 206/147, 150, 151, 157, 162, 193, 194, 427

[56] References Cited

U.S. PATENT DOCUMENTS

| | | | |
|---|---|---|---|
| 2,769,535 | 11/1956 | Bruce | 206/162 |
| 3,255,919 | 6/1966 | Koolnis | 206/194 |
| 3,442,421 | 5/1969 | Donahue | 206/194 |
| 4,471,870 | 9/1984 | Uhlig | 206/150 |
| 4,523,676 | 6/1985 | Barrash | 206/150 |

*Primary Examiner*—David T. Fidei
*Attorney, Agent, or Firm*—Thomas W. Buckman; Mark W. Croll; John P. O'Brien

[57] ABSTRACT

In a package for containers of a type having a side wall, a wrapper is formed from a paperboard sheet, folded, and seamed and has a bottom wall, two lateral walls providing expansive surfaces for labelling of the package, and two struts, which extend across the wrapper and divide the package into two endmost regions and an intermediate region. As formed from sheet-form, resilient, polymeric material, a carrier has band segments defining container-receiving apertures in two longitudinal rows, two endmost ranks, and two intermediate ranks, and a handle is attached to the carrier so as to extend upwardly from a longitudinal midline of the carrier. Each container is loosely received by one container-receiving aperture so that the band segments defining such aperture grip its side wall. The containers and the wrapper, carrier, and handle respectively are sized, shaped, and assembled so that the carrier is disposed above the bottom wall and below the struts, so that the containers received by the apertures of the endmost ranks are disposed within the endmost regions, above the bottom wall, so that the containers received by the apertures of the intermediate ranks are disposed within the intermediate region, above the bottom wall, between the lateral walls, and so that the handle extends upwardly between the struts, through the intermediate region of the wrapper.

7 Claims, 2 Drawing Sheets

WRAPPER, CARRIER, AND HANDLE ASSEMBLY AND PACKAGE COMPRISING SAME AND CONTAINERS

TECHNICAL FIELD OF THE INVENTION

This invention pertains to an assembly comprising a paperboard wrapper, a sheet-form, polymeric carrier for substantially identical containers, such as beverage bottles, and a handle extending upwardly from the carrier. This invention also pertains to a package comprising such containers and such an assembly. The wrapper stabilizes the containers and provides expansive surfaces for pricing, barcoding, and other labelling of the package.

BACKGROUND OF THE INVENTION

Commonly, cans, bottles, or other containers for soft drinks or other beverages are marketed in packages comprising four, six, eight, or twelve containers in machine-applied carriers made from sheet-form, resilient, polymeric material, such as low density polyethylene. The carriers are made, as by die-cutting, so as to have band segments defining container-receiving apertures that are designed to be stretched to receive cans and bottles.

Although such polymeric carriers have many advantages, particularly as compared to predominantly paperboard carriers, such polymeric carriers have some shortcomings. A major shortcoming is that such polymeric carriers do not provide expansive surfaces for pricing, barcoding, or other labelling of the packages.

As exemplified in Poupitch U.S. Pat. No. 2,874,835 and Poupitch U.S. Pat. No. 3,016,136, it has been known to employ separate wire or other handles with such polymeric carriers. Although handles as known heretofore are useful with such polymeric carriers, such known handles do not provide suitable labelling surfaces.

An improved carrier made from sheet-form, resilient, polymeric material, such as low density polyethylene, and having an upwardly extending handle portion made from similar polymeric material is disclosed in Broskow U.S. patent application Ser. No. 08/230,308 filed Apr. 20, 1994, and assigned commonly herewith. In the improved carrier disclosed therein, neither the carrier nor the handle provides suitable labelling surfaces.

This invention has resulted from efforts to provide an improved package for bottles or other containers for soft drinks or other beverages.

SUMMARY OF THE INVENTION

This invention provides a novel assembly for wrapping partially and carrying substantially identical containers, such as substantially identical bottles for soft drinks or other beverages. The novel assembly comprises a wrapper formed from a paperboard sheet, a carrier formed from sheet-form, resilient, polymeric material, and a handle attached to the carrier and extending upwardly from the carrier. The wrapper stabilizes the containers being carried and provides expansive surfaces for pricing, barcoding, and other labelling. The wrapper and carrier are designed to minimize material and to provide for easy bottle removal.

The wrapper is formed, folded, and seamed so as to have a bottom wall, two lateral walls, and struts extending across the wrapper. The lateral walls provide expansive surfaces for labelling. The struts extending across the wrapper include two struts dividing the wrapper into two endmost regions and an intermediate region.

The carrier is formed so as to have band segments defining container-receiving apertures in a generally rectangular array, which comprises two longitudinal rows and four transverse ranks including two endmost ranks and two intermediate ranks. The carrier has a longitudinal midline between the longitudinal rows of container-receiving apertures. As attached to the carrier, the handle extends upwardly from the longitudinal midline of the carrier. Preferably, the handle is be formed from similar polymeric material.

The wrapper, carrier, and handle respectively are sized, shaped, and assembled so that the carrier is disposed above the bottom wall and below the struts, so that the wrapper and more particularly the struts create a reaction force on the carrier to facilitate removal of each container from each container-receiving aperture, and so that the handle extends upwardly between two of the struts, through the intermediate region of the wrapper.

The struts may be joined to the lateral walls either at laterally extending folds or at vertically extending folds. The lateral walls may extend around the endmost regions of the wrapper.

In a package comprising substantially identical containers of a type having a side wall and the wrapper, carrier, and handle assembly described above, each container is received by one of the container-receiving apertures so that the band segments defining the same one of the container-receiving apertures grip the side wall of such container and so that the carrier remains in the package as each and every container is removed.

Preferably, the containers are gripped loosely by the band segments defining the container-receiving apertures to facilitate removal of each container from the package, whereas the bottom wall of the wrapper is disposed to prevent the containers from dropping through the carrier.

The carrier and wrapper combination described herein creates a stable package and provides for easy removal of each container without disturbing the stability of the remaining containers.

These and other objects, features, and advantages of this invention are evident from the following description of presently contemplated embodiments of this invention with reference to the accompanying drawings.

DETAILED DESCRIPTION OF ILLUSTRATED EMBODIMENTS

Figure 1:
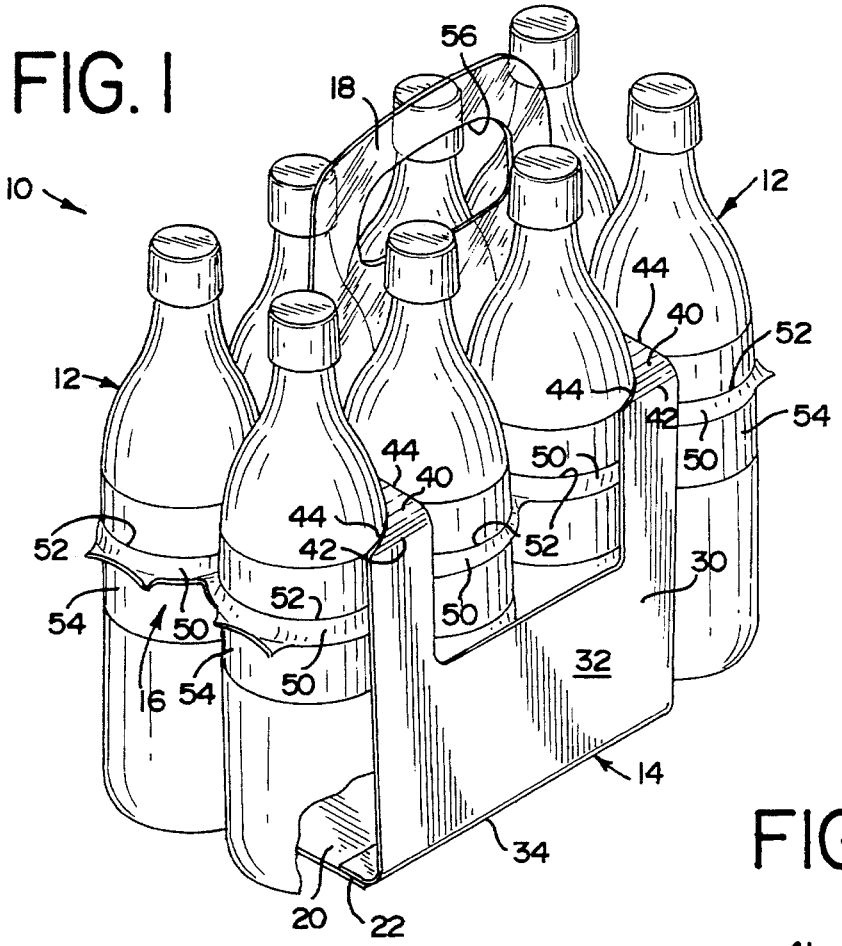
FIG. 1 is a perspective view of a first package embodying this invention and comprising eight substantially identical bottles, a paperboard wrapper, a polymeric carrier, and a polymeric handle. A portion of the package is broken away to reveal details that would be otherwise hidden.
Figure 2A:
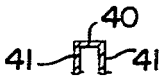
FIG. 2A is a partial, sectional view taken along line 2—2 in FIG. 2, showing the cross-sectional configuration of one of two struts of the wrapper.
Figure 2:
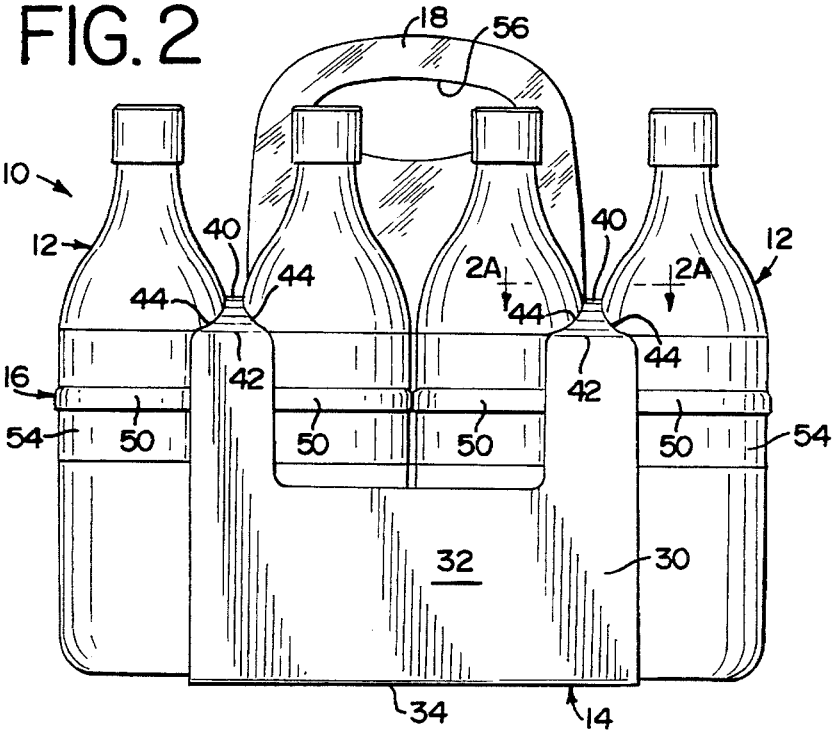
FIG. 2 is an elevational view of one side of the first package shown in FIG. 1.

As shown in FIGS. 1 and 2, a package 10 comprising eight substantially identical containers 12, a paperboard wrapper 14, a polymeric carrier 16, and a polymeric handle 18 constitutes a first embodiment of this invention. As shown, the containers 12 are bottles, which may contain soft drinks or other beverages. Alternatively, the containers 12 may be beverage cans (not shown) or other containers. The containers 12 are arranged in a generally rectangular array, which comprises two longitudinal rows and four transverse ranks, namely two endmost ranks and two intermediate ranks. The wrapper 14, the carrier 16, and the handle 18 provide an assembly for wrapping partially and carrying the containers 12. The wrapper 14 stabilizes the containers 12 being carried and provides expansive surfaces for pricing, barcoding, and other labelling.

The wrapper 14 is formed from a paperboard sheet, as by die-cutting. The wrapper 14 is formed, folded, and seamed so as to have a bottom wall 20 including a longitudinally extending, overlapped seam 22 utilizing a suitable adhesive, two similar, lateral walls 30 providing expansive labelling surfaces 32 and joined to the bottom wall 20 at longitudinally extending folds 34, and two seamless struts 40 extending across the wrapper 14 and joined to the lateral walls 30 at longitudinally extending folds 42. The struts 40 divide the wrapper 14 into two endmost regions and an intermediate region. The endmost regions accommodate the containers 12 in the endmost ranks. The intermediate region accommodates the containers 12 in the intermediate ranks. The struts 40 have scalloped edges 44 accommodating the adjacent containers 12 and permitting the struts 40 to extend between the adjacent containers 12.

The struts 40 are preferably U-shaped in cross-section, as shown in FIG. 2A, to provide structural and alignment features to the struts 40. The struts 40 are therefore capable of creating a wedging force on the adjacent containers 12. Each strut 40 has a primary surface extending horizontally and leg portions 41 extending vertically and contacting the side walls 54 of the adjacent containers 12.

The carrier 16 is formed from sheet-form, resilient, polymeric material, such as low density polyethylene, so as to have band segments 50 defining container-receiving apertures 52 is a generally rectangular array, which corresponds to the generally rectangular array of the containers 12. The carrier 16 has a longitudinal midline between the longitudinal rows of container receiving apertures 52. Each container 12 is received by one such aperture 52 so that the band segments 50 defining the same aperture 52 grip the side wall 54 of such container 12. The handle 18 is formed from similar polymeric material and is attached to the carrier 16, at a thermoplastic seam (not shown) extending along the longitudinal midline of the carrier 16, so as to extend upwardly from such midline, above the containers 12. An upper portion of the handle 18 has an elongate aperture 56, which can accommodate two or three fingers of one hand of a user, so as to facilitate lifting the package via the handle 18.

Preferably, the carrier 16 and the handle 18 are similar to the previously noted, improved carrier, which has a handle portion, as disclosed in U.S. patent application Ser. No. 08/230,308, supra, the disclosure of which is incorporated herein by reference.

As received by the container-receiving apertures 52 of the endmost ranks, the containers 12 of the endmost ranks are disposed within the endmost regions of the wrapper 14, above the bottom wall 20 thereof. Also, as received by the container-receiving apertures 52 of the intermediate ranks, the containers 12 of the intermediate ranks are disposed within the intermediate region of the wrapper 14, above the bottom wall 20 thereof. Each container 12 thus is confined at least partly by the lateral walls 30 of the wrapper 14. Moreover, the handle 18 extends upwardly between the struts 40, through the intermediate region of the wrapper 14.

Preferably, the containers 12 are gripped loosely by the band segments 50 defining the container-receiving apertures 52, so as to permit the containers 12 to be easily removed from the package 10. Typical band-type carriers are stretched 25% to 35%, but the carrier 16 is similar to the carrier illustrated and described in Van Erden U.S. Pat. No. 5,154,289 in being stretched less than 10%. However, the bottom wall 20 of the wrapper 14 is disposed partly beneath the containers 12 in the endmost ranks and wholly beneath the containers 12 in the intermediate ranks, so as to prevent the containers 12 from dropping through the carrier 16.

The struts 40 contribute to the stability of the package 10 by creating a wedging force on the containers 12. The struts 40 also create a reaction force that aids in the removal of the containers 12 from the loosely fitting apertures 52 and that permits the carrier 16 to remain in and with the package 10 after each container 12 is removed.

Figure 3:
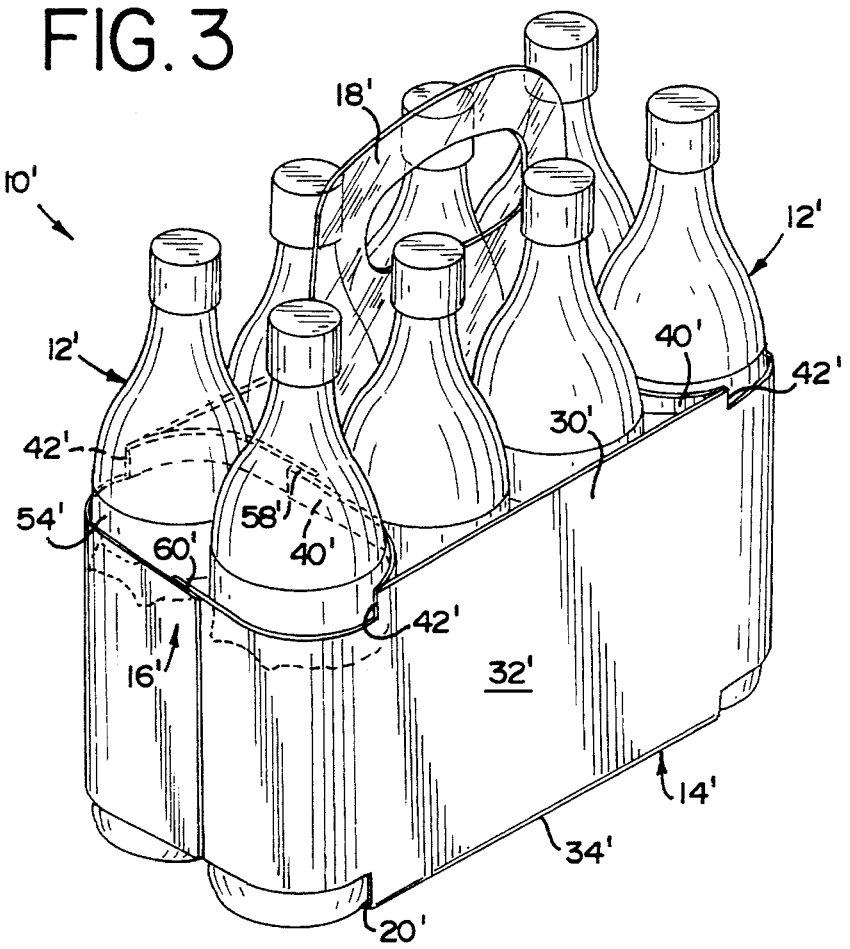
FIG. 3 is a perspective view of a second package embodying this invention and comprising eight substantially identical bottles, a paperboard wrapper, a polymeric carrier, and a polymeric handle. Some details that would be otherwise hidden are shown in broken lines.
Figure 4:
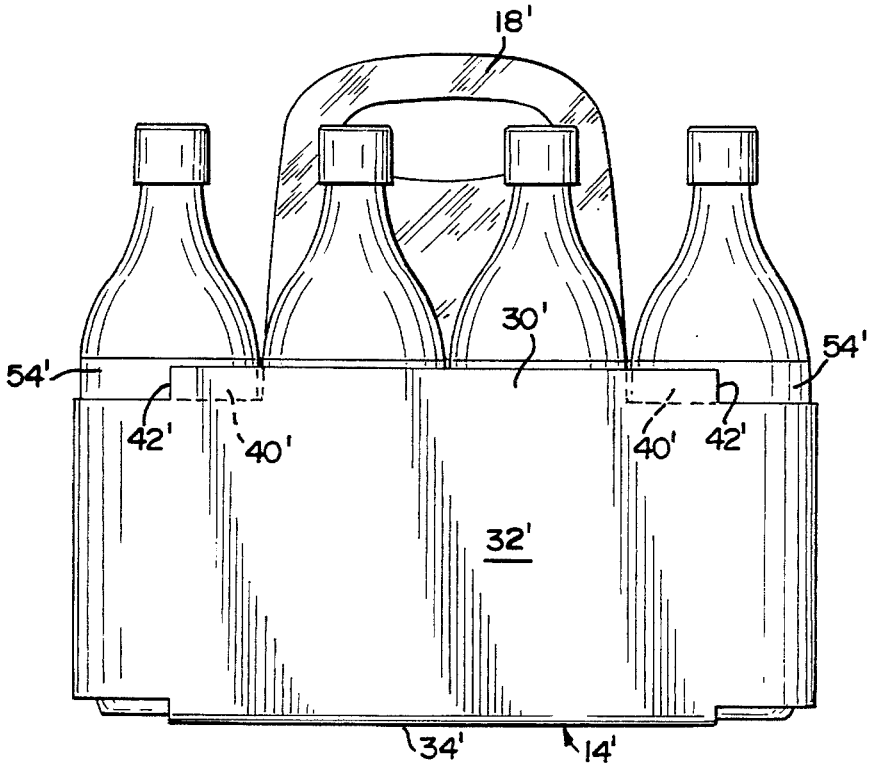
FIG. 4 is an elevational view of the second package shown in FIG. 3.

As shown in FIGS. 3 and 4, a package 10' comprising eight substantially identical containers 12', a paperboard wrapper 14', polymeric carrier 16', and a polymeric handle 18' constitutes a second embodiment of this invention. The containers 12' are similar to the containers 12 and are arranged similarly in a generally rectangular array, which comprises two longitudinal rows and four transverse ranks, namely two endmost ranks and two intermediate ranks. The handle 18' is similar to the handle 18. The wrapper 14', the carrier 16', and the handle 18' provide an assembly for wrapping partially and carrying the containers 12'. The wrapper 14' stabilizes the containers 12' being carried and provides expansive surfaces for pricing, barcoding, and other labelling.

The wrapper 14' is formed from a paperboard sheet, as by die-cutting. The wrapper 14' is formed, folded, and seamed so as to have a bottom wall 20', which is seamless, two similar, lateral walls 30' providing expansive labelling surfaces 32' and joined to the bottom wall 20' at longitudinally extending folds 34', and two struts 40' extending across the wrapper 14 and joined to the lateral walls 30 at vertically extending folds 42'. Each strut 40' has an overlapped seam 58' utilizing a suitable adhesive. The struts 40' divide the wrapper 14' into two endmost regions and an intermediate region. The struts 40' have surfaces that extend vertically of the package 10'. The endmost regions accommodate the containers 12' in the endmost ranks. The intermediate region accommodates the containers 12' in the intermediate ranks. The struts 40 are wrapped partly around the side walls 54' of the containers 12' in the endmost ranks and extend between the containers 12' in the endmost ranks and the containers 12' in the intermediate ranks to contribute to the stability of the package 10'. The lateral walls 30' extend around the endmost regions, and around the containers 12' in the endmost ranks, beyond the vertically extending folds 34'. The lateral walls 30' are joined to each other at each endmost region, creating end panels, each end panel having an overlapped seam 60' utilizing a suitable adhesive. The end panels contribute to the structural integrity of the package 10'.

As received by the container-receiving apertures 52' of the endmost ranks, the containers 12' of the endmost ranks are disposed within the endmost regions of the wrapper 14', above the bottom wall 20' thereof Also, as received by the container-receiving apertures 52' of the intermediate ranks, the containers 12' of the intermediate ranks are disposed within the intermediate region of the wrapper 14, above the bottom wall 20' thereof. Each container 12' thus is confined at least partly by the lateral walls 30' of the wrapper 14'. Moreover, the handle 18 extends upwardly between the struts 40', through the intermediate region of the wrapper 14'.

Preferably, the containers 12' are gripped loosely by the band segments 50' defining the container-receiving apertures 52', so as to permit the containers 12' to be easily removed from the package 10'. However, the bottom wall 20' of the wrapper 14' is disposed partly beneath the containers 12' in the endmost ranks and wholly beneath the containers 12' in the intermediate ranks, so as to prevent the containers 12' from dropping through the carrier 16'.

The packages created by this invention are designed to be stable, i.e. independent movements of the bottles or other containers are minimized, while permitting a reduction of material for each of the carrier and wrapper portions.

Various modifications may be made in either embodiment described above without departing from the scope and spirit of this invention.

We claim:

1. A wrapper, carrier, and handle assembly for wrapping partially and carrying substantially identical containers as a package, such as substantially identical bottles, the assembly comprising (a) a wrapper formed from a paperboard sheet, folded, and seamed so as to have a bottom wall, two lateral walls providing expansive surfaces for labelling, and struts extending across the wrapper, above the bottom wall, the struts including two struts dividing the package and the containers in the package into two endmost regions and an intermediate region, (b) a carrier formed from sheet-form, resilient, polymeric material so as to have band segments defining container-receiving apertures in a generally rectangular array, which comprises two longitudinal rows and at least three transverse ranks including two endmost ranks and at least one intermediate rank, the carrier having a longitudinal midline between the longitudinal rows of container-receiving apertures, and (c) a handle attached to the carrier and extending upwardly from the longitudinal midline of the carrier, wherein the wrapper, carrier, and handle respectively are sized, shaped, and assembled so that the carrier is disposed above the bottom wall and below the struts, so that the container-receiving apertures of the endmost ranks are disposed within the endmost regions of the package, so that the container-receiving apertures of each intermediate rank are disposed within the intermediate region of the package, and so that the handle extends upwardly between two of the struts, through the intermediate region of the wrapper.

2. The wrapper, carrier, and handle assembly of claim 1 wherein the struts are joined to the lateral walls at longitudinally extending folds.

3. The wrapper, carrier, and handle assembly of claim 2 wherein the struts are U-shaped in cross-section.

4. The wrapper, carrier, and handle assembly of claim 1 wherein the struts are joined to the lateral walls at vertically extending folds.

5. The wrapper, carrier, and handle assembly of claim 1 wherein the lateral walls extend around the endmost regions of the wrapper.

6. The wrapper, carrier, and handle assembly of claim 1 wherein the handle is integral with the carrier.

7. The wrapper, carrier, and handle assembly of claim 1 wherein the containers are gripped loosely by the band segments defining the container-receiving apertures.

* * * * *